US005172822A

United States Patent [19]

DeFrance

[11] Patent Number: 5,172,822

[45] Date of Patent: Dec. 22, 1992

[54] LID PROTECTOR FOR PAINT CANS AND THE LIKE

[76] Inventor: Robert DeFrance, 48 Catskill Ave., Poughkeepsie, N.Y. 12603

[21] Appl. No.: 649,467

[22] Filed: Feb. 1, 1991

[51] Int. Cl.[5] ..... B65D 25/00

[52] U.S. Cl. ..... 220/733

[58] Field of Search ..... 220/90

[56] References Cited

U.S. PATENT DOCUMENTS

| | | | |
|---|---|---|---|
| 3,469,735 | 9/1969 | Burt | 220/90 |
| 3,693,829 | 9/1972 | Price | 220/90 |
| 3,744,671 | 7/1973 | Saunders, Jr. | 220/90 |
| 4,203,537 | 5/1980 | McAlister | 220/90 |
| 4,220,254 | 9/1980 | Morton | 220/90 |
| 4,225,064 | 9/1980 | Westcott | 220/90 |
| 4,312,459 | 1/1982 | Leach | 220/90 |
| 4,911,319 | 3/1990 | DeJean | 220/90 |
| 4,955,500 | 9/1990 | Rhoads | 220/90 |

FOREIGN PATENT DOCUMENTS

| | | | |
|---|---|---|---|
| 39283 | 2/1971 | Australia | 220/90 |

*Primary Examiner*—Joseph Man-Fu Moy

*Attorney, Agent, or Firm*—Kane, Dalsimer, Sullivan, Kurucz, Levy, Eisele & Richard

[57] ABSTRACT

A lid protector for a paint can comprise a vertical outer wall and an inner wall and an intermediate price extending at an upward and outward angle direction connected to the outer and inner walls. The protector can be in the shape of a ring and is dimensioned to fit over the rim of a can.

2 Claims, 2 Drawing Sheets

LID PROTECTOR FOR PAINT CANS AND THE LIKE

FIELD OF THE INVENTION

Disclosed and claimed herein is a protective device which fits upon the rim of a paint can or similar container when the lid of the can is removed. When the paint or other contents of the can are withdrawn from the container, the device protects the sealing grooves, thereby preventing paint from entering grooves and fouling the fit of the lid back upon the top of the can.

BACKGROUND OF THE INVENTION

Whether a person undertakes to paint a room or to shellack a chair, the process is invariably the same. The individual will pry open the lid of the can and then either dip the brush into the can, brushing off the excess on the rim, or pour a portion of the contents into some other containing vessel. Either way, the contents of the container will flow into the grooves upon the top of the can. The presence of the paint or varnish acts as a fouling factor, causing a myriad of problems. If the lid is fitted upon the can after use, the liquid present in the grooves bonds the lid to the can, thereby making the can difficult to open. An equally probable occurrence is the presence of the dried, hardened liquid upon the rim preventing the can from being sealed in an air tight manner. Air will enter the can and dry up the contents, rendering it unusable. Moreover, after paint fills the groove it will begin to run down the side of the can, causing a sloppy mess.

SUMMARY OF THE INVENTION

It is an object of the invention to provide a lid protector for paint cans and the like which prevents the contents of the can from entering the grooves upon the top rim of the can when the can is in the open position.

It is a further object of the invention to provide a means for wiping off the excess paint from a brush and permitting it to re-enter the can.

Other objects shall become apparent for the disclosure of invention below.

The invention is a unitary piece construction shaped as a circumferential ring. The cross section of the invention can be generally described as an inverted U-shape device which permits the invention to be force fit over the groove or lip of the paint can.

DETAILED DESCRIPTION OF THE PREFERRED EMBODIMENT

Figure 1:
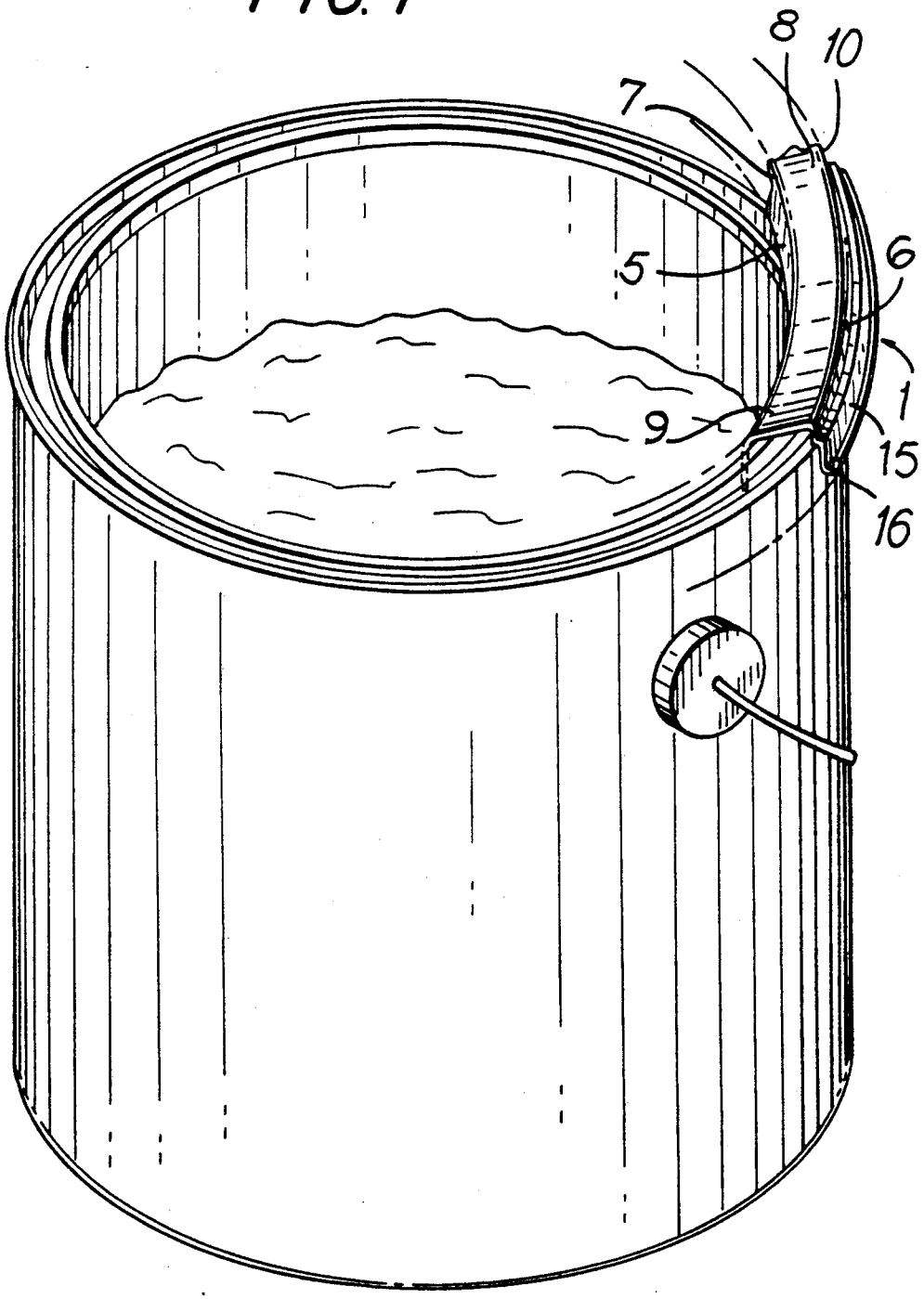
FIG. 1 is a perspective view of the invention.
Figure 3:
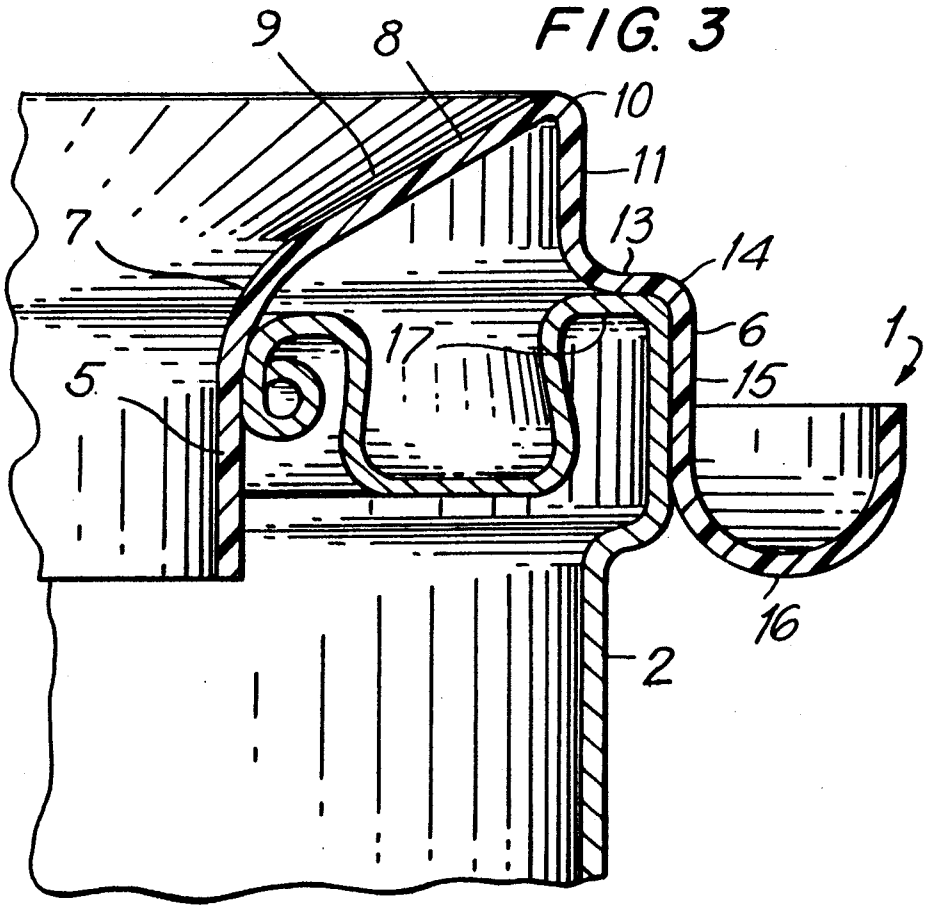
FIG. 3 is a cross sectional view along line A—A.
Figure 2:
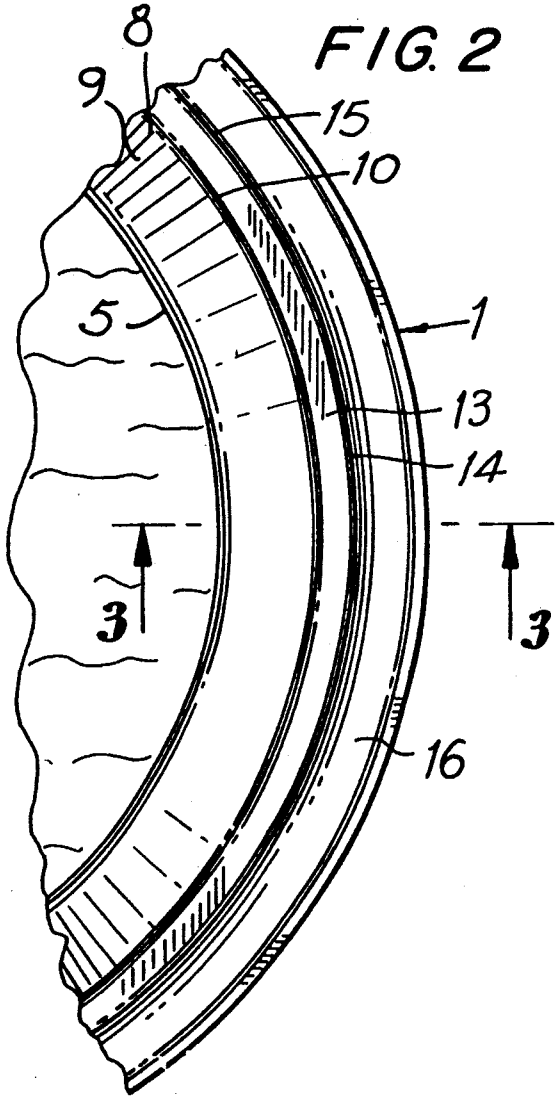
FIG. 2 is a perspective view of the invention fitted upon the rim of a paint can.

The lid protector 1 of the present invention is formed of a unitary construction from a thermoplastic resin such as polyethylene or polypropylene. The protector can be extruded or molded from any means known to those skilled in the art.

The invention is generally provided with side walls indicated as inner wall 5 and outer wall 6 connected by means of an intermediate portion 8. The side walls and connecting portion are of suitable dimensions so as to contact and grip the rim of the paint can 2. Preferably, a part of the intermediate portion 8 is angled upward and away from the inner wall so as to form a funnel type top section 9. The angle 7 formed between this part of the intermediate portion 9 and by inner wall is preferably 60°. The formation of the funnel type top section creates a surface upon which the brush can be wiped in order to remove excess paint. The angle formed by the funnel type top section permits paint to drip back into the paint can.

A first outer circumference radius 10 at the top of the funnel type 9 top section of the intermediate piece adjoins to a circumferential vertical wall section 11, which in turn is connected to a second circumferential inside corner radius 12. The second circumferential inside radius 12 is formed between a circumferential horizontal ledge 13 and a third outer circumferential radius 14. (The inner section of the circumferential horizontal ledge 13 abuts (or sets) on the upper rim of the can.) The outer circumferential radius 14 is connected to a circumferential vertical wall 15, the protector reaches its terminus in a U-shaped hook 16 which serves as a trough or gutter on the outer circumferential of the can to prevent spilled over of paint or substance on the outer wall of the can, thus running down the side.

The lid protector is dimensioned so that it can be for a fit upon the circumferential lip or rim of an open can. The circumferential side walls of the protector are of a sufficient length so as to extend for approximately an inch within the interior of the can and for an inch upon the exterior of the can.

The paint can lid protector of the present invention can be constructed of a suitable thermoplastic material. The paint can protector can be formed by any means known in the art, such as extrusion or molding.

The paint can protector of the present invention can be sized to fit any size paint can. A person skilled in the art would be capable of determining the exact dimensions necessary to produce a protector for a one gallon can, to cite one possible example.

I claim:

1. A lid protector for paint cans and the like comprised of a) a substantially vertical outer wall;

b) a substantially vertical inner wall: and c) an intermediate piece extending at an upward and outward angle connected to the outer and inner walls, said protector can be in the shape of a ring and being dimensioned to fit over the rim of the can, the intermediate piece forming an upward and outward angle with respect to the circumferential inner wall greater than 90°, but less than 180°, so that at least a section of intermediate piece does not lie flush against the circumferential rim of the paint can, the inner circumferential vertical wall being the first section thereof, the inner circumferential vertical wall being connected by means of a first elbow to a second section formed of a circumferential angled portion of the intermediate piece, the intermediate piece being further comprised of a third section which is a substantially vertical component connected to the second section by means of second elbow, said third section being connected to a substantially horizontal fourth section by means of a third elbow forming a right angle between the third section and the fourth section, said fourth section being connected to the outer wall by means of a fourth elbow forming a right angle between the fourth section and the outer wall of the lid protector.

2. The lid protector as set forth in claim 1 wherein the circumferential outer wall is further comprised of a circumferential U-shaped hook which curves away from the outer wall of the paint can.

* * * * *